US007554507B2

(12) United States Patent
Kwon et al.

(10) Patent No.: US 7,554,507 B2
(45) Date of Patent: Jun. 30, 2009

(54) UWB ANTENNA WITH UNIDIRECTIONAL RADIATION PATTERN

(75) Inventors: Do-hoon Kwon, Seoul (KR); Yong-jin Kim, Seoul (KR); Seong-soo Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 134 days.

(21) Appl. No.: 11/354,923

(22) Filed: Feb. 16, 2006

(65) Prior Publication Data

US 2006/0181475 A1 Aug. 17, 2006

(30) Foreign Application Priority Data

Feb. 16, 2005 (KR) ..... 10-2005-0012751
Jan. 2, 2006 (KR) ..... 10-2006-0000149

(51) Int. Cl.
*H01Q 9/16* (2006.01)

(52) U.S. Cl. ..... 343/793; 343/866

(58) Field of Classification Search ..... 343/725, 343/726, 727, 700 MS, 702, 866, 793
See application file for complete search history.

(56) References Cited

U.S. PATENT DOCUMENTS

| | | | | |
|---|---|---|---|---|
| 5,872,542 | A * | 2/1999 | Simons et al. | 343/700 MS |
| 6,522,302 | B1 * | 2/2003 | Iwasaki | 343/726 |
| 6,600,450 | B1 * | 7/2003 | Efanov et al. | 343/726 |
| 6,917,334 | B2 * | 7/2005 | Chen | 343/700 MS |
| 6,937,193 | B2 * | 8/2005 | Hendler et al. | 343/700 MS |
| 7,119,745 | B2 * | 10/2006 | Gaucher et al. | 343/700 MS |
| 2003/0011525 | A1 * | 1/2003 | Sanad | 343/702 |

* cited by examiner

*Primary Examiner*—Trinh V Dinh
*Assistant Examiner*—Dieu Hien T Duong
(74) *Attorney, Agent, or Firm*—Sughrue Mion, PLLC

(57) ABSTRACT

An ultra wide band (UWB) antenna with a unidirectional radiation pattern, including: a power feeder including a connecting point at one end and a feeding point at the other end; and a radiator including a dipole part, connected with the feeding point on the basis of the feeding point, and a loop part, whose both ends are connected with both ends of the dipole part respectively to be closed-loop-shaped. Accordingly, a UWB antenna with a unidirectional radiation pattern which mainly performs radiation perpendicular to an antenna plane can be provided.

19 Claims, 8 Drawing Sheets

UWB ANTENNA WITH UNIDIRECTIONAL RADIATION PATTERN

CROSS-REFERENCE TO RELATED APPLICATIONS

This application claims priority from Korean Patent Application No. 10-2005-0012751 Feb. 16, 2005 and 10-2006-0000149 filed Jan. 2, 2006 in the Korean Intellectual Property Office, the entire contents of which are incorporated herein by reference.

BACKGROUND OF THE INVENTION

1. Field of the Invention

Apparatuses consistent with the present invention relate to an ultra wide band (UWB) antenna with a unidirectional radiation pattern, and particularly, to a UWB antenna with a unidirectional radiation pattern which mainly performs radiation perpendicular to an antenna plane.

2. Description of the Related Art

In general, a communications system uses a frequency of a particular band to transmit data. Circuit data and packet data are data used in a communications system.

Circuit data are data such as a voice signal for real-time transmission/reception. Packet data are more than a certain size and does not necessarily need real-time transmission.

A frequency band used to transmit the circuit data is usually narrow. To transmit the packet data, a frequency band wider than that of the circuit data is needed.

As described above, as an amount of data transmission increases, the wider a frequency band is needed. A wide frequency band is called a UWB.

The UWB is divided into plural sub-band frequency bands. A UWB communications system transmits data using the plural sub-band frequency bands so that a large amount of data per time can be transmitted.

In addition, a UWB communications system selects one of plural sub-band frequency bands and transmits data through the sub-band frequency band, so that data security can increase. That is, as the plural sub-band frequency bands are used sequentially, data security increases.

FIG. 1 shows frequency bands used in a UWB communications system.

Referring to FIG. 1, frequency bands used in the UWB communications system range from 3432 MHz to 10032 MHz. The UWB frequency bands are divided into four groups of A~D. There are three sub-band frequency bands for group A, two sub-band frequency bands for group B, four sub-band frequency bands for group C, and four sub-band frequency bands for group D.

The reference frequencies of three sub-band frequency bands for group A are 3432 MHz, 3960 MHz and 4488 MHz, the reference frequencies of two sub-band frequency bands for group B are 5016 MHz and 5808 MHz, the reference frequencies of four sub-band frequency bands for group C are 6336 MHz, 6864 MHz, 7392 MHz and 7920 MHz, and four sub-band frequency bands for group D are 8448 MHz, 8976 MHz, 9504 MHz and 10032 MHz. The sub-band frequency bands for group B are the same as frequency bands used in a wireless LAN, and the sub-band frequency bands for group D can not be used in the present technology level.

FIG. 2 is a schematic view of an antenna suggested to be used in a conventional UWB communications system.

In FIG. 2, the antenna is a wideband antenna with a U-slot, and forms a resonance structure between a radiator, formed at both sides of a substrate, and a ground plane in which radiation occurs at both sides of a patch.

A wideband antenna with a U-slot is cost-effective and can obtain a gain of 5~7 dB in one direction on the basis of the ground plane. However, a wideband antenna with U-slot has a narrower bandwidth than a bandwidth used in a UWB communications system.

Additionally, U.S. Pat. No. 6,642,903 discusses a method of implementing a wideband by forming a wide plane conductor in a wire dipole which is a narrowband antenna.

The antenna disclosed in U.S. Pat. No. 6,642,903 maximizes radiation perpendicular to a substrate in a low frequency, maximizes radiation on the substrate in a high frequency, and comparatively has a same-directional radiation pattern. However, a directional radiation pattern can not be obtained due to having a small-sized antenna.

In addition, Koshelev, et. al., "Ultrawideband radiators of high-power pulses," in Proc. IEEE Int. Pulsed Power Plasma Science Conf. #2, pp. 1661-1664, 2001 obtains directivity of the right direction by the combination of an electric antenna and a magnetic antenna.

That is, Koshelev, et. al. can obtain a large gain of 5 dB or more in front, but the size of the antenna is large and power feeding has to be performed perpendicularly behind the antenna.

SUMMARY OF THE INVENTION

The present invention provides a UWB antenna, which is the combination of a dipole antenna and a loop antenna, with a unidirectional radiation pattern which mainly performs radiation perpendicular to the antenna plane.

According to an aspect of the present invention, there is provided a UWB antenna with a unidirectional radiation pattern, comprising a power feeder comprising a connecting point at one end and a feeding point at the other end; and a radiator comprising a dipole part, connected with the feeding point on the basis of the feeding point, and a loop part, whose both ends are connected with both ends of the dipole part respectively to be closed-loop-shaped.

The power feeder may be implemented with a transmission line of a microstrip form comprising a signal line and a ground plane, and the ground plane may gradually become narrower from the connecting point to the feeding point.

Additionally, the UWB antenna may further comprise extend parts which perpendicularly extend from ends of the signal line and the ground plane at the feeding point to be connected with the dipole part, respectively.

Further, the power feeder may be implemented with a transmission line of a coplanar waveguide (CPW) form comprising the signal line and the ground plane, and the ground plane at the feeding point is narrower than that at the connecting point.

Further, the power feeder may further comprise a pair of parallel transmission lines, which is parallel strip-shaped, and whose one ends are connected with the signal line and the ground plane respectively, and the other ends are connected with the dipole part.

Further, the dipole part and the loop part may be formed with one conductive board.

Further, the loop part except for the dipole part in the radiator may be formed on the same plane as the power feeder.

Further, the dipole part may extend upward at a certain angle from a location where the dipole part and the feeding point are connected with each other, gradually becoming wide externally, and being bent downward at a certain location to be connected with the loop part.

Further, the dipole part gradually may become wide externally from a location where the dipole part is connected with the feeding point, being parallel to the power feeder, and being bent downward at a certain location to be connected with the loop part.

Further, the dipole part may be formed by removing a part of the downward bent surface, which contacts the power feeder, in a certain size or area.

Further, the dipole part may be symmetrical on the basis of the feeding point.

Further, the UWB antenna may further comprise a dielectric substrate mounted with the power feeder and the radiator.

Further, the power feeder and the loop part may be formed by being coated with metal on the dielectric substrate.

Further, the loop part may be parallel formed of a pair of strips at both sides in the length direction on the dielectric substrate.

Further, the dipole part may be formed by removing the rest except for a part, which is connected with the loop part, of the downward bent surface.

BRIEF DESCRIPTION OF THE DRAWING FIGURES

The above and other aspects of the present invention will become more apparent by describing in detail exemplary embodiments thereof with reference to the attached drawing figures, wherein.

DETAILED DESCRIPTION OF THE EXEMPLARY EMBODIMENTS

Figure 1:
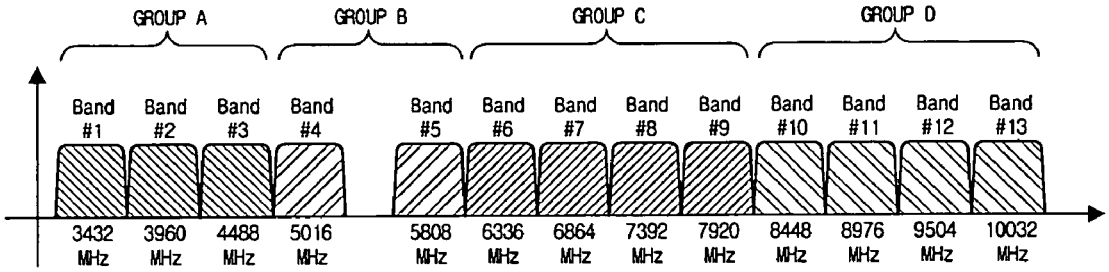
FIG. 1 (PRIOR ART)
FIG. 1 shows frequency bands used in a UWB communications system.
Figure 2:
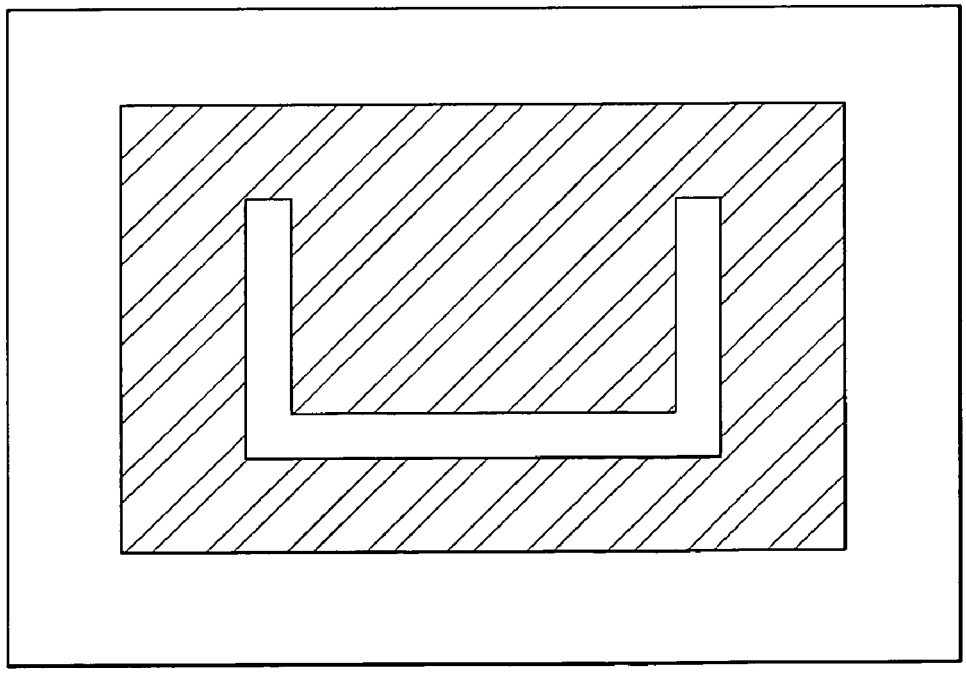
FIG. 2 (PRIOR ART)
FIG. 2 is a schematic view of an antenna suggested to be used in a conventional UWB communications system.

Hereinafter, exemplary embodiments of the present invention will be described in detail with reference to the accompanying drawing figures.

In the following description, same drawing reference numerals are used for the same elements even in different drawings. The matters defined in the description such as a detailed construction and elements are provided to assist in a comprehensive understanding of the invention. Thus, it is apparent that the present invention can be carried out without those defined matters. Also, well-known functions or constructions are not described in detail since they would obscure the invention in unnecessary detail.

Figure 3:
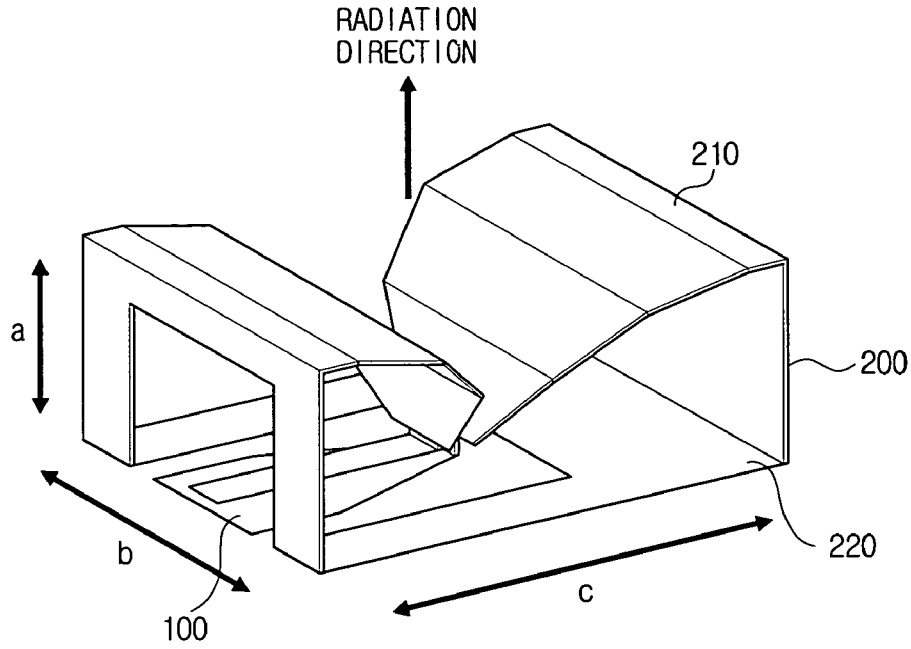
FIG. 3 is a perspective view of a UWB antenna according to a first exemplary embodiment of the present invention.
Figure 4:
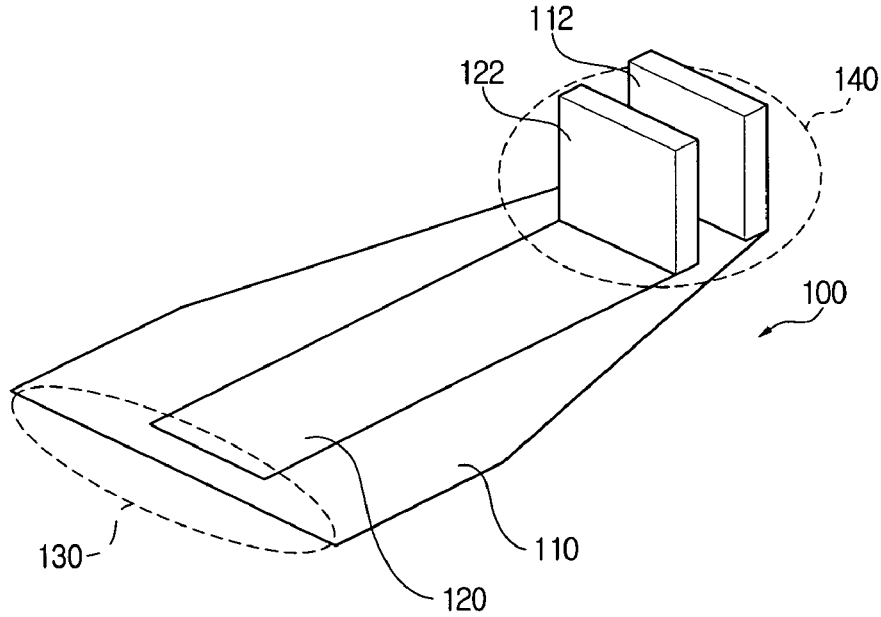
FIG. 4 is a perspective view of the power feeder applied to the UWB antenna of FIG. 3.

FIG. 3 is a perspective view of a UWB antenna according to a first exemplary embodiment of the present invention, and FIG. 4 is a perspective view of the power feeder applied to the UWB antenna of FIG. 3.

Referring to FIG. 3, a UWB antenna according to the first exemplary embodiment of the present invention includes a power feeder 100 for supplying an electric current and a radiator 200 for radiating an electromagnetic wave by the electric current supplied from the power feeder 100.

The power feeder 100 supplies an electric current to the radiator 200. That is, the power feeder 100 is connected to an external terminal to receive an electric current, and transmits the electric current to the radiator 200.

The specific structure of the power feeder 100 is shown in FIG. 4. The power feeder 100 has a connecting point 130 at one end for being connected with the external terminal and receiving an electric current, and a feeding point 140 at the other end for being connected with the radiator 200 and supplying an electric current to the radiator 200.

In this exemplary embodiment, the power feeder 100 is implemented with a transmission line of a microstrip form having a signal line 120 and a ground plane 110. The ground plane 110 may gradually become narrower from the connecting point 130 to the feeding point 140.

The reason why the connecting point 130 is formed more widely than the feeding point 140 is that generally the characteristic impedance of the connecting point 130 is set at 50Ω and when the characteristic impedance of the feeding point 140 is about 55~60Ω, optimum characteristic of a wide band is implemented. To make the characteristic impedance of the feeding point 140 to be 55~60Ω, the width of the ground plane 110 at the feeding point 140 has to be narrower than the width of the ground plane 110 at the connecting point 130.

At the feeding point 140 of the power feeder 100, ends of the signal line 120 and the ground plane 110 perpendicularly extend to form extend parts 122, 112, respectively. The signal line 120 and the ground plane 110 are connected with a dipole part 210 through the extend parts 122, 112, respectively.

FIG. 4 illustrates that the signal line 120 and the ground plane 110 in the power feeder 100 seem to contact each other, but this is just for convenience of explanation. Actually, the signal line 120 and the ground plane 110 may be distanced apart from each other. Accordingly, as an air layer is formed between the signal line 120 and the ground plane 110, an extra dielectric substrate is not needed.

The radiator 200 radiates an electromagnetic wave by the electric current supplied from the power feeder 100 and is constructed to excite a dipole antenna and a loop antenna with one power feed at the same time.

The radiator 200 includes a dipole part 210, connected to the feeding point 140 on the basis of the feeding point 140 of the power feeder 100, and a loop part 220, whose both ends are connected with respective ends of the dipole part 210 to be closed-loop-shaped.

The dipole part 210 is distanced from the power feeder 100 and is symmetrical on the basis of the feeding point 140. The dipole part 210 extends upward at a certain angle from a location where the dipole part 210 and the feeding point 140 are connected to each other, gradually gets wider externally, and is bent downward at a certain location to be connected with the loop part 220.

Additionally, the dipole part 210 is formed by removing a part of the downward bent surface to be connected with the loop part 220, which contacts the power feeder 100, in a certain size or area. Accordingly, power feeding is conventionally only performed at the bottom, but now can be performed at the side.

The loop part 220 forms a closed loop shape by connection with the dipole part 210. As shown in FIG. 3, the loop part 220 is partly removed for the power feeder 100.

The radiator 200 including the dipole part 210 and the loop part 220 can be manufactured by bending a wide conductive board. Additionally, to make room for the power feeder 100 and for power feeding at a side, the dipole part 210 and the loop part 220 may partly be removed.

According to exemplary embodiments of the present invention, a radiation direction of a UWB antenna employing the radiator 200 including the dipole part 210 and the loop part 220 is perpendicular to the dipole part 210 and the loop part 220 in the arrowed direction.

In the radiator 200, the length of a, the length of b, and the length of c as shown in FIG. 3 may be 10 mm, 20 mm, and 25 mm, respectively. The lengths of a, b and c can be modified, but the length of b may not be longer than the length of c to implement a superior antenna.

In exemplary embodiments of the present invention, as shown in FIG. 3, a wide conductive board is used to manufacture the radiator 200 so that a dipole antenna, a loop antenna and a time delay element can be constructed to make complete offset and reinforcement between the dipole antenna and the loop antenna in a wide band.

Figure 5:
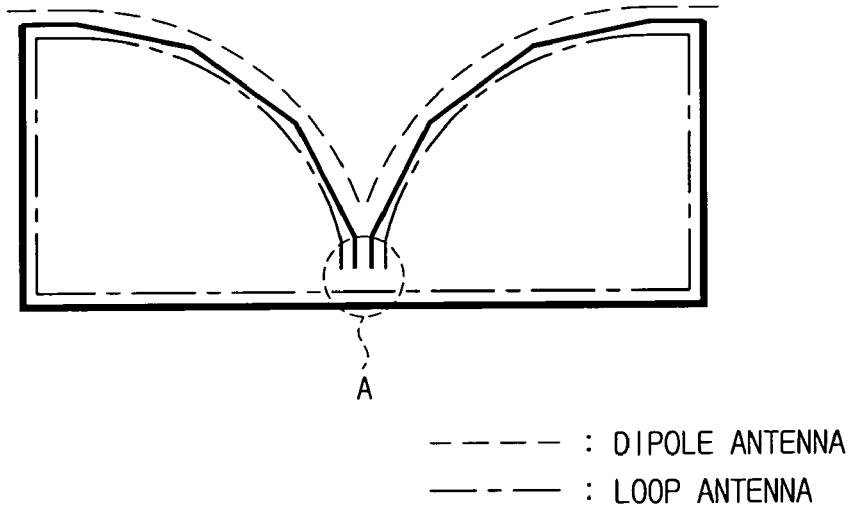
FIG. 5 is a schematic side view of the UWB antenna of FIG. 3.

FIG. 5 schematically shows a side view of the UWB antenna of FIG. 3.

Referring to FIG. 5, it is shown that the radiator 200 of the UWB antenna according to the first exemplary embodiment of the present invention is the combination of the dipole antenna and the loop antenna. Accordingly, the radiator 200 can partly perform the operation of the dipole antenna, and can overall perform the operation of the loop antenna.

As shown in FIG. 5, the UWB antenna is symmetrical on the basis of the part A connected with the feeding point 140. That is, the shape of the dipole antenna, partly using the radiator 200, is completely symmetrical, and also the combined shape of the dipole antenna and the loop antenna, overall using the radiator 200, is symmetrical.

As described above, as the combined shape of the dipole antenna and the loop antenna is symmetrical on the basis of the part A connected with the feeding point 140, a radiation pattern hardly misses the main radiation direction.

Figure 6:
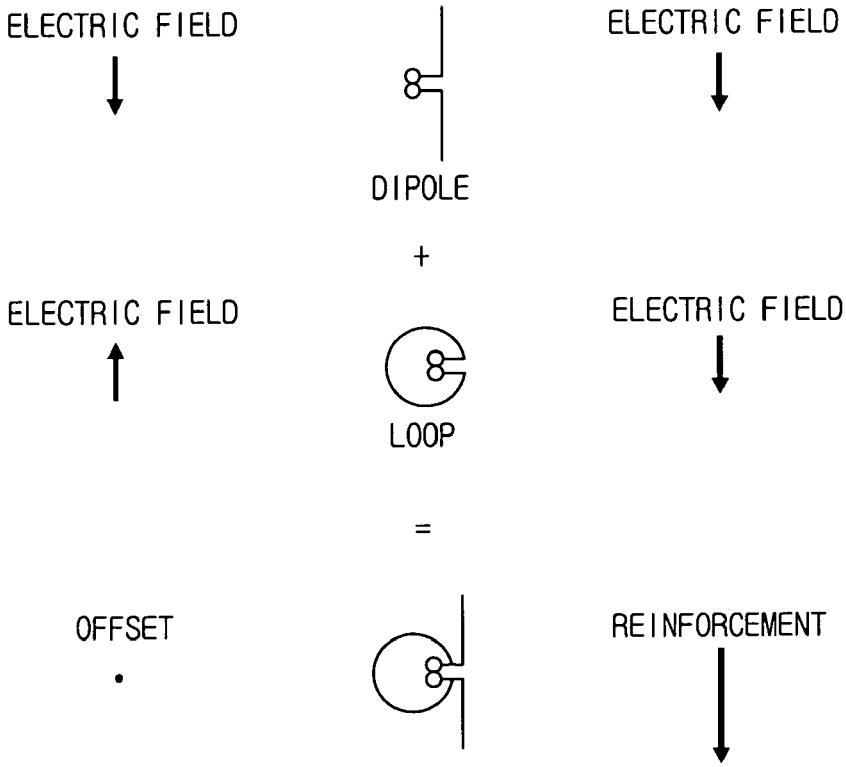
FIG. 6 is a view describing the principle of obtaining a unidirectional radiation pattern in a UWB antenna according to exemplary embodiments of the present invention.

FIG. 6 is a view describing the principle of obtaining a unidirectional radiation pattern in a UWB antenna according to exemplary embodiments of the present invention. FIG. 6 shows the polarity of the electric field generated in the far-field region distanced from on the basis of the UWB antenna.

The electric fields radiated from an electric antennal (dipole), storing electric energy before radiation, and a magnetic antenna (loop), storing magnetic energy before radiation, have different polarity in the far-field region. Therefore, when the electric antennal and the magnetic antenna are excited at the same time, offsetting or reinforcing the electric field is enabled according to the observation direction.

As shown in FIG. 6, in the case of the dipole part 210, if an electric current is supplied through the power feeder 100 to the radiator 200, the electric fields are generated downward on one side and the other side of the radiator 200 respectively. That is, electric fields of the same polarity are generated.

On the other hand, in the case of the loop part 220, if an electric current is supplied through the power feeder 100 to the radiator 200, the electric fields are generated upward on one side of the radiator 200 and downward on the other side. That is, electric fields of different polarities are generated.

Consequently, if a UWB antenna with the radiator 200 combining the dipole part 210 and the loop part 220 is implemented, the electric field is offset in one side and reinforced in the other side. Accordingly, the UWB antenna according to exemplary embodiments of the present invention forms a unidirectional radiation pattern.

Figure 7:
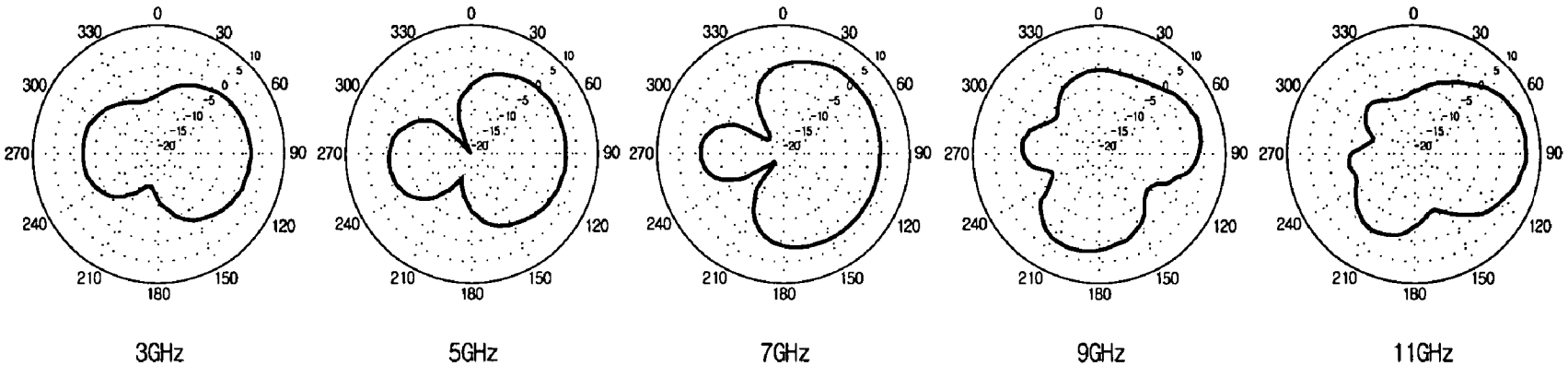
FIG. 7 shows a radiation pattern in an electric plane of a UWB antenna according to exemplary embodiments of the present invention.

FIG. 7 shows a radiation pattern in an electric plane of a UWB antenna according to exemplary embodiments of the present invention. FIG. 7 shows a radiation pattern in an electric plane of a UWB antenna according to exemplary embodiments of the present invention at 3 GHz, 5 GHz, 7 GHz, 9 GHz, and 11 GHz, respectively.

As described above, the dipole part 210 stores electric energy before radiation and the loop part 220 stores magnetic energy before radiation. Accordingly, if the radiator 200 combining the dipole part 210 and the loop part 220 is implemented, radiation can occur in a low frequency band such as 3GHz, where radiation does not occur in the dipole part 210 and the loop part 220, respectively.

As shown in FIG. 7, the UWB antenna according to exemplary embodiments of the present invention maximizes radiation in the main radiation direction (90°) in each frequency band. Particularly, as the radiator 200 forms the symmetrical structure on the basis of the feeding point 140, the radiation pattern rarely misses the main radiation direction.

Figure 8:
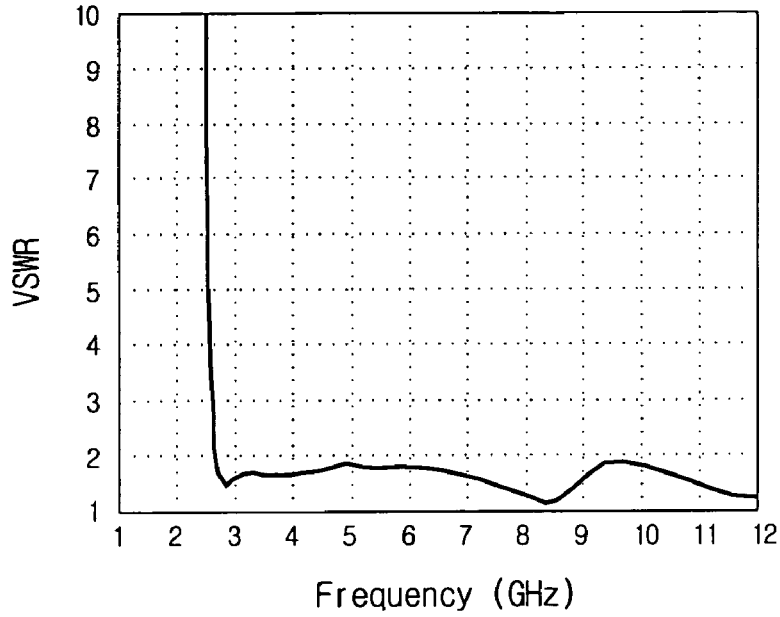
FIG. 8 shows the VSWR according to the frequency of a UWB antenna according to exemplary embodiments of the present invention.
Figure 9:
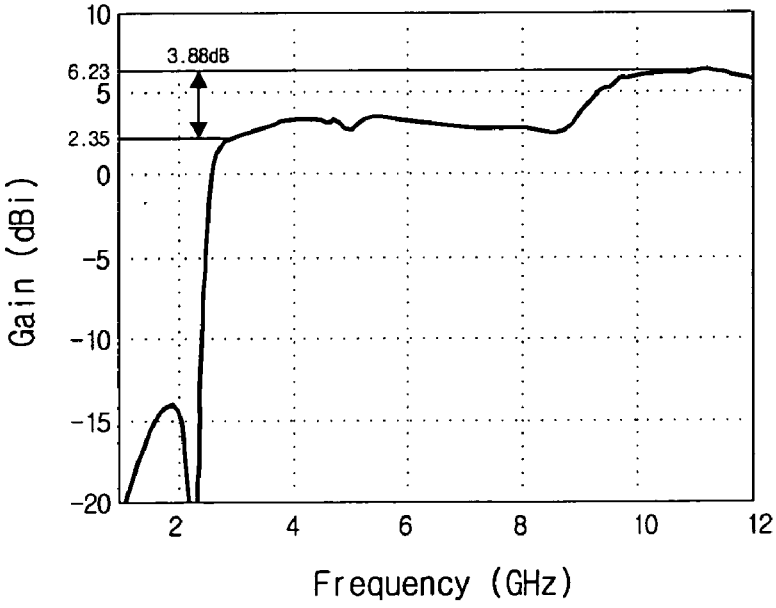
FIG. 9 shows a gain according to the frequency of a UWB antenna according to exemplary embodiments of the present invention.
Figure 10:
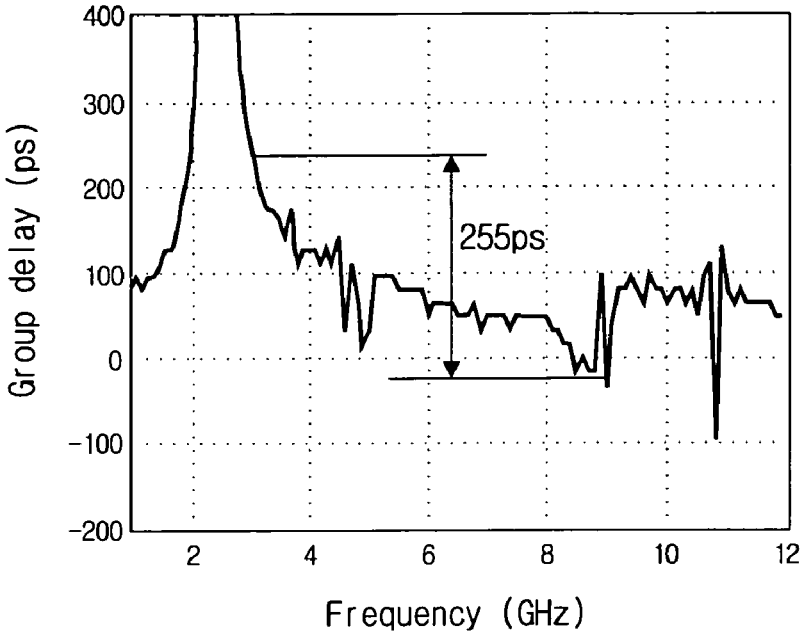
FIG. 10 shows a group delay according to the frequency of a UWB antenna according to exemplary embodiments of the present invention.

FIG. 8 shows the voltage standing wave ratio (VSWR) according to the frequency of a UWB antenna according to exemplary embodiments of the present invention, FIG. 9 shows a gain according to the frequency of a UWB antenna according to exemplary embodiments of the present invention, and FIG. 10 shows a group delay according to the frequency of a UWB antenna according to exemplary embodiments of the present invention. FIGS. 8 through 10 show effects of a UWB antenna according to exemplary embodiments of the present invention.

Referring to FIG. 8, the VSWR according to a UWB frequency band is low in a UWB. That is, the VSWR is high at 1~2 GHz and is less than 2 at more than 3 GHz.

Referring to FIG. 9, a gain according to a UWB frequency band is considerably high in the UWB.

Specifically, a gain is −15 dBi at 1~2 GHz, sharply high at close to 3 GHz, 2.35 dBi at 3 GHz, and 6.23 dBi at 11 GHz. A gain difference between 3 GHz and 11 GHz is 3.88 dBi.

Referring to FIG. 10, a group delay, which is a signal defect occurred by different frequencies, according to a UWB frequency band is low in the UWB. Accordingly, a linear phase can be obtained according to frequency.

Figure 11:
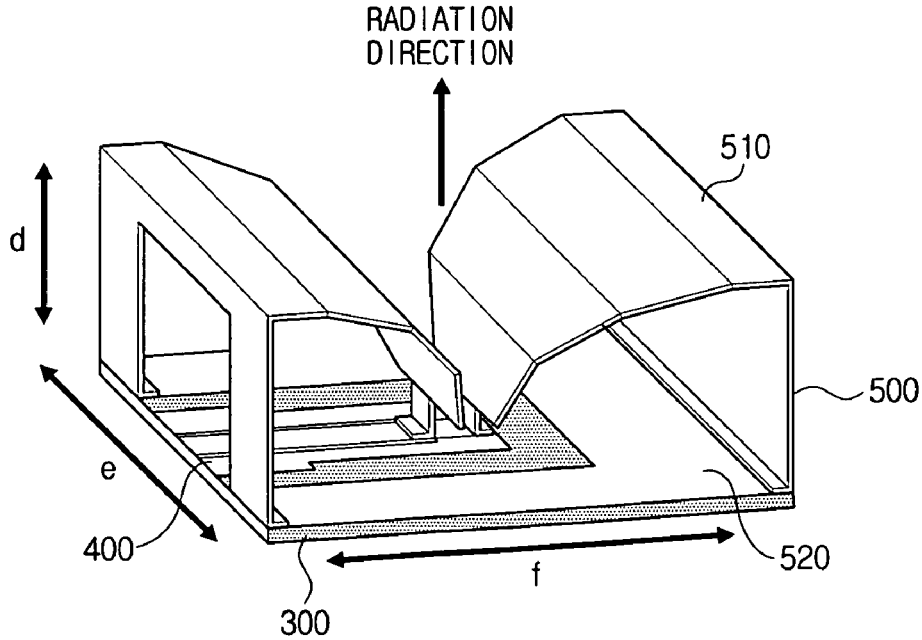
FIG. 11 is a perspective view of a UWB antenna according to a second exemplary embodiment of the present invention.
Figure 12:
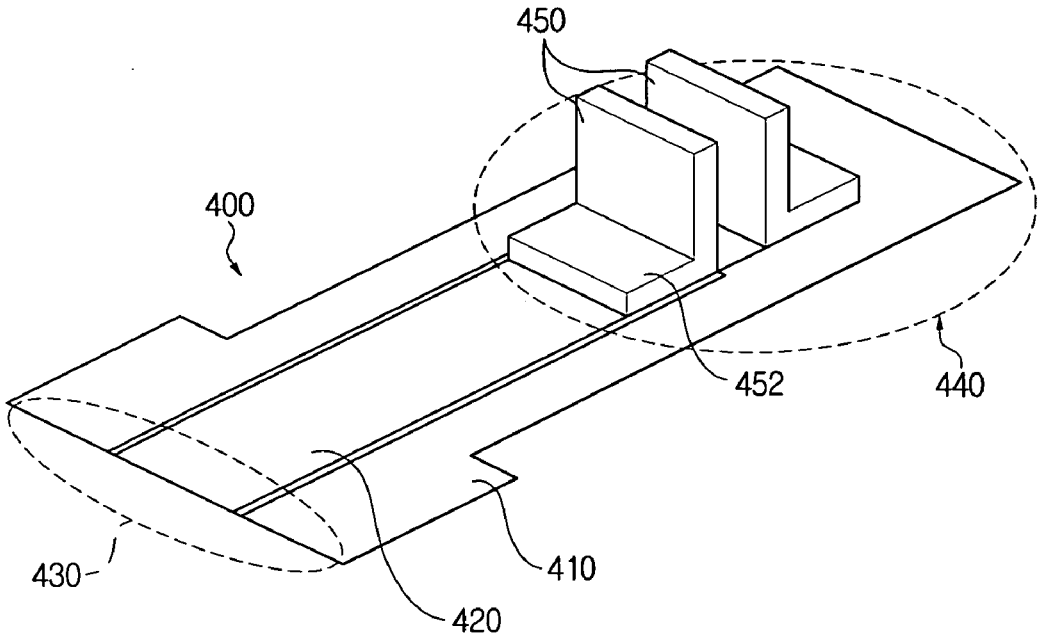
FIG. 12 is a perspective view of the power feeder applied to the UWB antenna of FIG. 1.

FIG. 11 is a perspective view of a UWB antenna according to a second exemplary embodiment of the present invention, and FIG. 12 is a perspective view of the power feeder applied to the UWB antenna of FIG. 11.

The UWB antenna according to the second exemplary embodiment of the present invention in FIG. 11 has a similar structure to the UWB antenna according to the first exemplary embodiment of the present invention in FIG. 3, so only differences in structure will be explained below.

A power feeder 400 has a connecting point 430 at one end, and a feeding point 440 at the other end for being connected with a radiator 500 as in the first exemplary embodiment.

The power feeder 100 is implemented with a transmission line of a microstrip form in the first embodiment, but the power feeder 400 is implemented with a transmission line of a coplanar waveguide (CPW) form in the second exemplary embodiment.

In the power feeder 400, a signal line 420 and a ground plane 410 are formed on the same plane. Specifically, the ground plane 410 is located at both sides of the signal line 420.

The width of the ground plane 410 is reduced at a certain location in the length direction, so a part with relatively wide width and a part with narrow width are divided. That is, the width of a part close to the connecting point 430 is relatively wide and the width of a part close to the feeding point 440 is relatively narrow. However, a structure is not limited to the above structure, and the ground plane 410 may be formed to gradually become narrow, as shown by the ground plane 110 from the connecting point 130 to the feeding point 140 in the first exemplary embodiment of FIG. 1.

The power feeder 400 is formed by being coated with metal such as copper on the upper part of a dielectric substrate 300. As the power feeder 400 is implemented with a transmission line of a CPW form using the dielectric substrate 300, a space between the signal line 420 and the ground plane 410 is easily kept regular compared with the structure of a transmission line not using the dielectric substrate 300 by a printed circuit board (PCB) technology, and a UWB antenna can be inexpensively implemented.

The power feeder 400 includes a pair of parallel transmission lines 450, which is parallel strip-shaped, in the feeding point 440, whose one set of ends is connected with the signal line 420 and the ground plane 410 respectively, and the other set of ends is connected with a dipole part 510. The pair of parallel transmission lines 450 may have the same width as the signal line 420.

As the pair of parallel transmission lines 450 has the same structure and is located to face each other, it is considered as balanced transmission lines. The pair of parallel transmission lines 450 is formed on the power feeder 400 so that perpendicular power feeding can be easily converted into parallel power feeding in a transmission line of a CPW form.

In order to firmly fix the pair of parallel transmission lines 450 on the power feeder 400, the pair of parallel transmission lines 450 may include a respective fixing pad 452, which is perpendicularly bent from the one end connected with the feeding point 440 and extends to some extent.

The radiator 500 includes a pole part 510, formed on the basis of the feeding point 440 of the power feeder 400, and a loop part 520, connected with the dipole part 510 and closed-loop-shaped, similar to the radiator 200 in the first exemplary embodiment.

The radiator 200 including the dipole part 210 and the loop part 220 in the first exemplary embodiment can be manufactured by bending a conductive board, but the radiator 500 in the second exemplary embodiment can be manufactured by connecting the separate dipole part 510 and loop part 520.

The dipole part 510 is formed with a pair of conductive boards whose one set of ends is connected with the pair of parallel transmission lines 450, respectively and whose other set of ends is connected with both ends of the loop part 520, respectively. A pair of the conductive boards is symmetrical on the basis of the feeding point 440.

As shown in FIG. 11, a pair of the conductive boards forming the dipole part 510 extends upward at a certain angle at the location where the pair of parallel transmission lines 450 connects with the dipole part 510, gradually becomes wide externally, and is bent downward at a certain location to be connected with the loop part 520.

The loop part 520 is formed by being coated with metal on the dielectric substrate 300 and is distanced from the power feeder 400 on the same dielectric substrate 300.

In the radiator 500, the length of d, the length of e, and the length of f as shown in FIG. 11 may be 10.813 mm, 20 mm, and 25 mm, respectively. The lengths of d, e and f can be modified, but when the length of e is shorter than the length of f, a superior antenna can be implemented rather than when the length of e is longer than the length of f.

Figure 13:
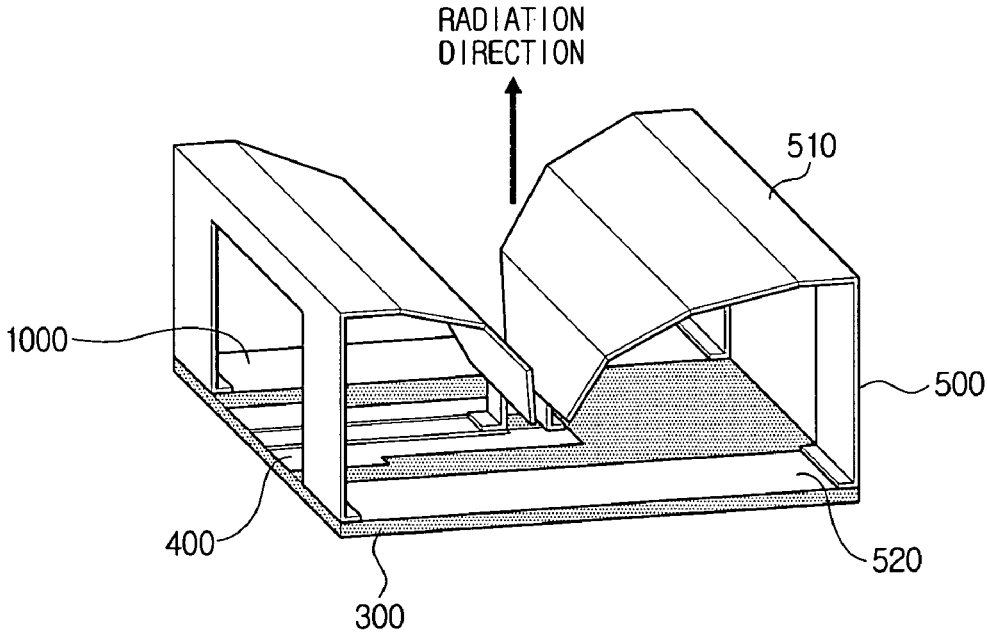
FIG. 13 is a perspective view of a UWB antenna according to a third exemplary embodiment of the present invention.

FIG. 13 is a perspective view of a UWB antenna according to a third exemplary embodiment of the present invention. The UWB antenna according to the third exemplary embodiment of the present invention as shown in FIG. 13 has a similar structure to the UWB antenna according to the second exemplary embodiment of the present invention in FIG. 11.

In the second exemplary embodiment, the dipole part 510 is formed by removing only a part of the downward bent surface, which is close to the power feeder 400, in a certain size.

In the third exemplary embodiment however, a certain size of the two downward bent surfaces to be connected with the loop part 520 in the dipole part 510 are symmetrically removed. That is, the two conductive boards forming the dipole part 510 are identically shaped. Accordingly, savings can be realized due to the amount of a conductor saved in manufacturing the UWB antenna.

In addition, the loop part 520 is formed by being coated with metal on the dielectric substrate 300 as in the second exemplary embodiment. The loop part 520 is not formed on the entire dielectric substrate 300 except for the location where the power feeder 400 is formed as in the second exemplary embodiment, but is parallel formed of a pair of strips at both sides in the length direction on the dielectric substrate 300.

Figure 14:
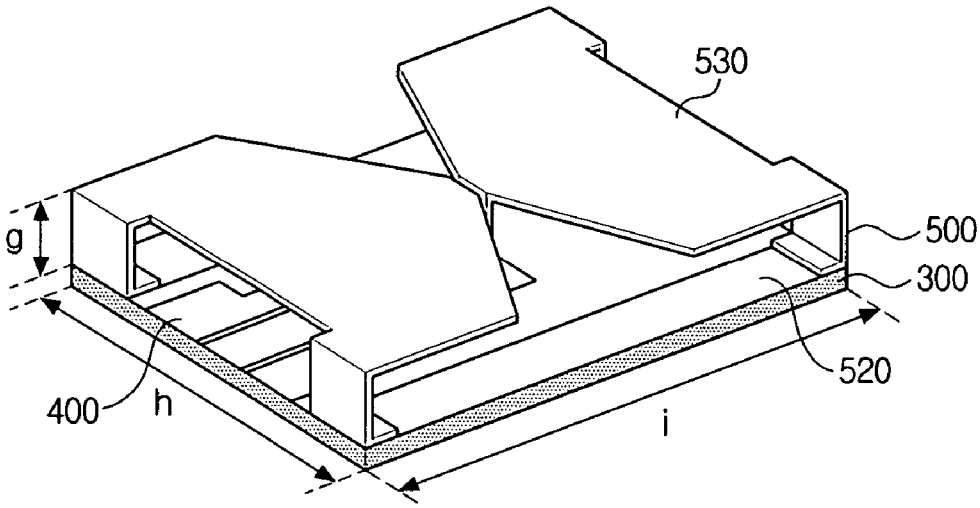
FIG. 14 is a perspective view of a UWB antenna according to a fourth exemplary embodiment of the present invention.
Figure 15:
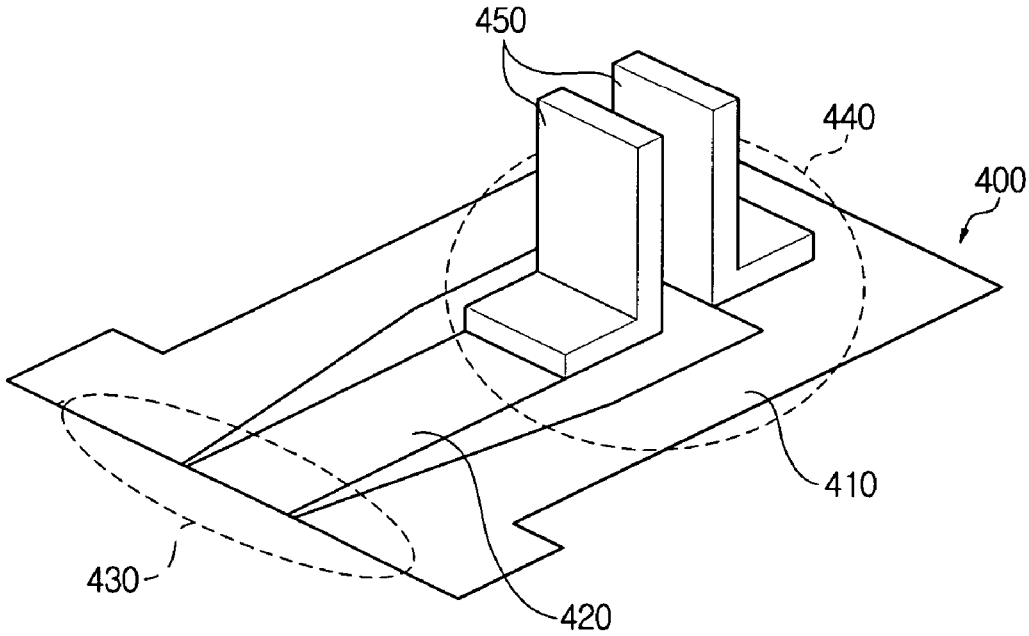
FIG. 15 is a perspective view of the power feeder applied to the UWB antenna of FIG. 14.

FIG. 14 is a perspective view of a UWB antenna according to a fourth exemplary embodiment of the present invention, and FIG. 15 is a perspective view of the power feeder applied to the UWB antenna of FIG. 14.

The UWB antenna according to the fourth exemplary embodiment of the present invention in FIG. 14 has a similar structure to the UWB antenna according to the third exemplary embodiment of the present invention in FIG. 13.

A dipole part 530 gradually becomes wider externally from a location where two conductive boards are connected with the feeding point 440. In order to be parallel to the dielectric substrate 300, one set of ends of the dipole part 530 is connected with a pair of parallel transmission lines 450 respectively, and the other set of ends of the dipole part 530 is connected with both ends of the loop part 520, respectively.

Additionally, in the fourth exemplary embodiment, it is exemplified that the power feeder 400 is implemented with a transmission line of a CPW form, whose characteristic impedance gradually varies, as shown in FIG. 15. The gradual change in the characteristic impedance of the transmission line of a CPW can be implemented by gradually changing a space between a signal line 420 and a ground plane 410.

In the radiator 500, the length of g can vary such as 2 mm, 3 mm, 4 mm and 5 mm. Additionally, the length of h, and the length of i may be 16 mm and 21 mm, respectively. The longer the length of g, which is the height of the radiator 500, the more improved the directivity, and the shorter the height of the radiator 500, the smaller the size of the antenna.

The dipole part 530 in the fourth exemplary embodiment is somewhat low in directivity, but accommodates a smaller space compared to the dipole parts in the first to fourth exemplary embodiments, so that it is very practical when applied to the UWB antenna.

As can be appreciated from the above description of UWB antennas with a unidirectional radiation pattern according to exemplary embodiments of the present invention, a radiator combining a dipole part and a loop part is implemented so that radiation is mainly occurring perpendicular to the antenna surface and a radiation pattern does not miss the main radiation direction.

Additionally, the dipole part close to a power feeder is partly removed so that power feeding at a side is enabled. Also, a UWB antenna smaller than conventional small dipole antennas can be implemented.

While the invention has been shown and described with reference to exemplary embodiments thereof, it will be understood by those skilled in the art that various changes in form and details may be made therein without departing from the spirit and scope of the invention as defined by the appended claims.

What is claimed is:

1. An ultra wide band antenna with a unidirectional radiation pattern, the ultra wide band antenna comprising:

a power feeder comprising a connecting point at one end and a feeding point at another end; and a radiator comprising a dipole part connected with the feeding point, the dipole part being symmetrical on the basis of the feeding point, and a loop part whose ends are respectively connected with ends of the dipole part to be closed-loop-shaped, wherein the dipole part extends upward at a certain angle from a location where the dipole part and the feeding point are connected with each other, the dipole part gradually becoming wider externally and bent downward at a certain location to be connected with the loop part.

2. The ultra wide band antenna of claim 1, wherein the power feeder is implemented with a transmission line of a microstrip form comprising a signal line and a ground plane, and the ground plane gradually becomes narrower from the connecting point to the feeding point.

3. The ultra wide band antenna of claim 2, further comprising extend parts which perpendicularly extend from respective ends of the signal line and the ground plane at the feeding point, to be connected with the dipole part.

4. The ultra wide band antenna of claim 1, wherein the power feeder is implemented with a transmission line of a coplanar waveguide form comprising a signal line and a ground plane, and the ground plane at the feeding point is narrower than at the connecting point.

5. The ultra wide band antenna of claim 4, wherein the power feeder further comprises a pair of parallel transmission lines in a parallel strip-shape, a set of ends of the pair of transmission lines being connected with the signal line and the ground plane respectively, and another set of ends being connected with the dipole part.

6. The ultra wide band antenna of claim 1, wherein the dipole part and the loop part are formed with one conductive board.

7. The ultra wide band antenna of claim 1, wherein the loop part is formed on a same plane as the power feeder, and the dipole part in the radiator is formed on a different plane as the power feeder.

8. The ultra wide band antenna of claim 1, wherein the dipole part is formed by removing a particular sized part of the downward bent surface which contacts the power feeder.

9. The ultra wide band antenna of claim 1, wherein the dipole part gradually becomes wider externally from a location where the dipole part is connected with the feeding point, is parallel to the power feeder, and is bent downward at a certain location to be connected with the loop part.

10. The ultra wide band antenna of claim 9, wherein the dipole part is formed by removing a particular sized part of the downward bent surface which contacts the power feeder.

11. The ultra wide band antenna of claim 9, further comprising a dielectric substrate mounted with the power feeder and the radiator.

12. The ultra wide band antenna of claim 11, wherein the power feeder and the loop part are formed by being coated with metal on the dielectric substrate.

13. The ultra wide band antenna of claim 11, wherein the loop part is parallel formed of a pair of strips at both sides in a length direction on the dielectric substrate.

14. The ultra wide band antenna of claim 11, wherein the dipole part is formed by retaining a part, which is connected with the loop part, of the downward bent surface.

15. The ultra wide band antenna of claim 1, further comprising a dielectric substrate mounted with the power feeder and the radiator.

16. The ultra wide band antenna of claim 15, wherein the power feeder and the loop part are formed by being coated with metal on the dielectric substrate.

17. The ultra wide band antenna of claim 15, wherein the loop part is parallel formed of a pair of strips at both sides in a length direction on the dielectric substrate.

18. The ultra wide band antenna of claim 15, wherein the dipole part is formed by retaining a part, which is connected with the loop part, of the downward bent surface.

19. The ultra wide band antenna of claim 1, wherein the power feeder comprises a signal line and a ground plane which are directly connected and in a same plane.

* * * * *